US005326282A

United States Patent [19]

Igarashi et al.

[11] Patent Number: 5,326,282

[45] Date of Patent: Jul. 5, 1994

[54] MINIATURE MULTIPLE ELECTRICAL CONNECTOR

[75] Inventors: Yoshiaki Igarashi; Yukio Saitoh; Fumio Furuya; Akio Yamada, all of Tokyo, Japan

[73] Assignee: Daiichi Denshi Kogyo Kabushiki Kaisha, Japan

[21] Appl. No.: 127,335

[22] Filed: Sep. 27, 1993

Related U.S. Application Data

[62] Division of Ser. No. 10,842, Jan. 29, 1993, abandoned, which is a division of Ser. No. 814,405, Dec. 23, 1991, Pat. No. 5,201,675.

[30] Foreign Application Priority Data

Dec. 27, 1990 [JP] Japan ..... 2-405192[U]

[51] Int. Cl.[5] ..... H01R 13/658

[52] U.S. Cl. ..... 439/607

[58] Field of Search ..... 439/607-610

[56] References Cited

U.S. PATENT DOCUMENTS 4,579,408 4/1986 Sasaki ..... 439/374
4,718,866 1/1988 Yamaguchi ..... 439/607
5,030,130 7/1991 Natsume ..... 439/374
5,037,330 8/1991 Fulponi et al. ..... 439/607

FOREIGN PATENT DOCUMENTS 273589 11/1987 European Pat. Off. .
292144 5/1988 European Pat. Off. .

*Primary Examiner*—Gary F. Paumen
*Attorney, Agent, or Firm*—Silverman, Cass & Singer, Ltd.

[57] ABSTRACT

A miniature multiple electrical connector consists of a plug connector and a receptacle connector having an insulating block and a metal shell. The metal shell is fixed to the insulating block by fitting anchoring protrusions provided along both sides of the insulating block in anchoring apertures of fixing tongues provided on the metal shell. When the plug connector is being inserted into the receptacle connector, the metal shell of the receptacle connector is likely to be deformed by a metal shell of the plug connector. In order to prevent such a deformation of the metal shell, there is provided means for anchoring the center of the metal shell weakest in mechanical strength to the insulating block or means for preventing application of a force to the center of the metal shell when the plug connector is being inserted into the receptacle connector.

2 Claims, 7 Drawing Sheets

MINIATURE MULTIPLE ELECTRICAL CONNECTOR

This is a division of application Ser. No. 08/010,842 filed Jan. 29, 1993, now abandoned, which is a division of application Ser. No. 07/814,405 filed Dec. 23, 1991, now U.S. Pat. No. 5,201,675.

BACKGROUND OF THE INVENTION

This invention relates to a miniature multiple electrical connector which is able to prevent deformation of a metal shell for shielding.

With miniaturization of electronic appliances, multiple connectors for use in connections between circuits have been strongly required to be more miniaturized. Moreover, connectors have often been required to have very narrow widths, although long lengths are accepted, depending upon the amount of space available in electronic appliances in which the connections are used. Therefore, thin type miniature multiple electrical connectors are not unusual which have a great number (for example, as many as 80) of contacts arranged in insulating blocks, for example, having a width of about 6 mm and a length of about 50 min.

With a connector used in an electronic appliance, the following means has been provided in order to prevent malfunctioning of the appliance due to outward noise. As shown in FIGS. 6*a* and 6*b* illustrating a plug connector A, contacts 1 are arranged on the fitting protrusion 2*a* of an insulating block 2 having mounting flanges 2*b* at both its ends. A trapezoid metal shell 3 is formed with punched projections 3*a* arranged in rows on inner sides thereof for contacting (as later described) and has mounting flanges 3*b* at both its ends. The metal shell 3 is fixed on the insulating block 2 to surround the fitting protrusion 2*a* of the insulating block 2 with clearances therebetween.

On the other hand, as shown in FIGS. 6*c* and 6*d* illustrating a receptacle connector B mating with the plug connector A shown in FIGS. 6*a* and 6*b*, contacts 4 are arranged in two rows on the inside of the fitting recess 5*a* of an insulating block 5 having mounting flanges 5*b*. A trapezoid metal shell 6 having mounting flanges 6*a* at both its ends is fixed on the mounting flanges 5*b* of the insulating block 5 to surround the fitting recess 5*a* of the insulating block 5 so that the metal shell 6 is inserted in the metal shell 3 of the plug connector A to be in contact therewith through the punched projections 3*a* thereof. When the plug connector A is inserted into the receptacle connector B, the contacts 1 and 4 are brought into contact with each other and simultaneously the metal shells 3 and 6 are also brought into electrical contact with each other to be connected to an earth circuit. The conductive portions of the plug and receptacle connectors A and B are shielded in this manner.

In the prior art described above, however, upon inserting the plug connector A into the receptacle connector B, the metal shell 6 of the receptacle connector B is often deformed as shown by broken lines in FIG. 7, making the insertion impossible due to means for fixing the metal shell 6 to the insulating block 5 of the receptacle connector B as explained hereinafter.

As shown in FIGS. 6*c* and 6*d* and FIG. 7, the metal shell 6 is provided along its lower edges on both sides with a plurality of fixing tongues 6*b* each extending downwardly and having an anchoring aperture 6*c*. In the embodiment shown in FIG. 6*d*, the fixing tongues 6*b* are provided at both the ends and at the center of the metal shell 6. On the other hand, the insulating block 5 is provided along both its sides with anchoring protrusions 5*c* adapted to be fitted in the anchoring apertures 6*c* of the fixing tongues 6*b* of the metal shell 6 so that the metal shell 6 is fixed to the insulating block 5.

With such fixing means, when the metal shell 6 is fitted onto the insulating block 5, the fixing tongues 6*b* ride over the anchoring protrusions 5*c* and then the anchoring protrusions 5*c* snap into the anchoring apertures 6*c*. The fixing means simplify the assembling of the receptacle connector B and make possible the thin construction of the receptacle connector B.

On the other hand, at the beginning of the insertion of the plug connector A into the receptacle connector B, particularly the fixing tongues 6*b* at the center, tend to disengage from the anchoring protrusions 5*c* to release the fixation therebetween and the metal shell 6 thereby becomes considerably deformed by further insertion of the plug connector A into the receptacle connector B.

As a result, even if the plug connector A can be forcedly removed from the receptacle connector B, the plug connector A can seldom be inserted thereinto again because of the deformation of the metal shell 6 which must then be replaced with a new one.

SUMMARY OF THE INVENTION

It is an object of the invention to provide a miniature multiple connector which is able to prevent in a reliable manner the metal shell of the receptacle connector from being deformed.

The invention resides in a discovery that the deformation of the metal shell of the receptacle connector is caused by the following reason. It is usual in most cases that the plug connector A is inserted into the receptacle connector B under a condition of the former being more or less tilted relative to the latter as shown in FIG. 7. Therefore, in inserting the plug connector A into the receptacle connector B, first the one lower edge of the metal shell 3 of the plug connector A abuts against the one upper edge of the metal shell 6 of the receptacle connector B to apply a high downward force to the upper edge of the metal shell 6.

As the metal shell 6 is made of a thin metal plate having a low mechanical strength, the center portion of the one upper edge of the metal shell 6 is particularly weak in mechanical strength against the high downward force in comparison with both the ends of the metal shell 6 having the mounting flanges 6*a*. Therefore, the center portion of the metal shell 6 slides down on the upper portion of the insulating block 5 so as to expand outwardly as shown by broken lines in FIG. 7. As a result, the anchoring protrusion 5*c* provided at the center of the insulating block 5 is disengaged from the anchoring aperture 6*c* of the fixing tongue 6*b* so that the center portion of the metal shell 6 is further deformed owing to a further applied downward force.

In order to prevent such a deformation of the metal shell 6, the anchoring protrusions 5*b* may be made higher so as to prevent removal from the anchoring apertures 6*c* of the fixing tongues 6*b*. However, the heights of the anchoring protrusions 5*c* are already of the order of 1 to 1.5 mm for a connector, for example, having a width of 6 mm. It is impossible to make the heights of the anchoring protrusions 5*c* higher than that, owing to the limitation of the width of the connector. The present invention solves this problem by providing the metal shell 6 of the receptacle connector B with means resisting the downward force of the metal shell 3 of the plug connector A.

In a preferred embodiment of the invention, the metal shell of the receptacle connector is provided in the proximity of the center of its length with at least one bridge portion which is laid across both the upper edges of the metal shell, and the insulating block of the receptacle connector is formed with a release notch corresponding to the bridge portion.

According to another embodiment of the invention, the metal shell of the receptacle connector is provided with at least two insert tongues, one on each side thereof, formed by partially cutting the lower edge of the metal shell and raising the part between cut lines, and the insulating block of the receptacle connector is formed with tongue receiving apertures, one on each side thereof, for receiving the insert tongues of the metal shell.

In a further embodiment of the invention, the metal shell of the plug connector is provided with contacting punched projections which are to be in contact with the metal shell of the receptacle connector and arranged at positions remote from the insert edge of the metal shell as they approach the center of the metal shell.

In a preferred embodiment, the metal shell of the plug connector is formed with deformation preventing notches, one on each side thereof, whose center is deeper than both ends of the notch.

According to the invention, deformation of the metal shell of the receptacle connector is prevented in a reliable manner without changing the length and width of the connector. The miniature multiple electrical connector comprising the means for preventing the metal shell from being deformed according to the invention has an additional advantage of maintaining the interchangeability thereof with electrical connectors of similar kinds.

The invention will be more fully understood by referring to the following detailed specification and claims taken in connection with the appended drawings.

BRIEF DESCRIPTION OF THE DRAWINGS

FIGS. 2*a* and 2*d* are respectively perspective views illustrating the plug connector and the receptacle connector shown in FIGS. 2*a* and 2*b;*

DESCRIPTION OF THE PREFERRED EMBODIMENTS

Figure 1A:
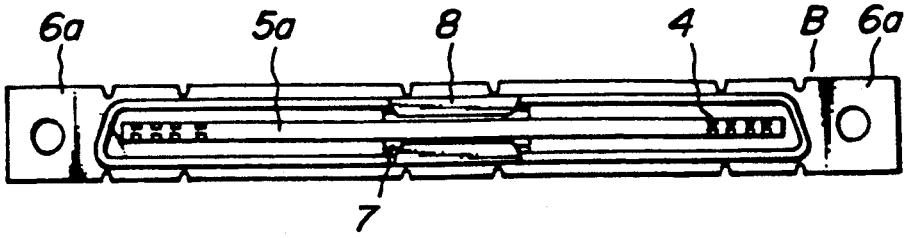
FIGS. 1*a*, 1*b* and 1*c* are respectively a plan view, a partially sectional front elevation and a partial perspective view illustrating the receptacle connector of a miniature multiple electrical connector of one embodiment of the invention.
Figure 1B:
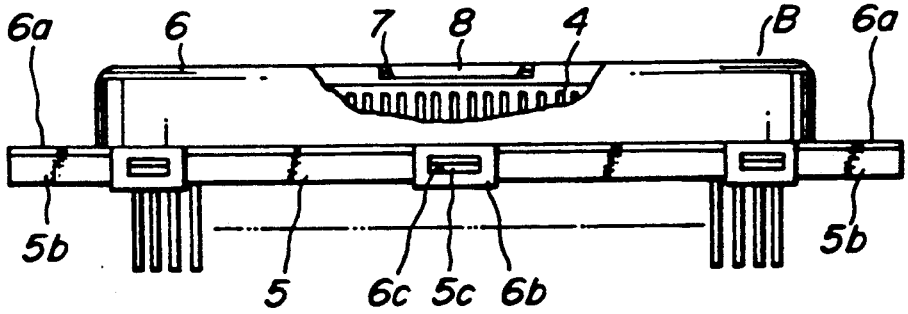
Figure 1C:
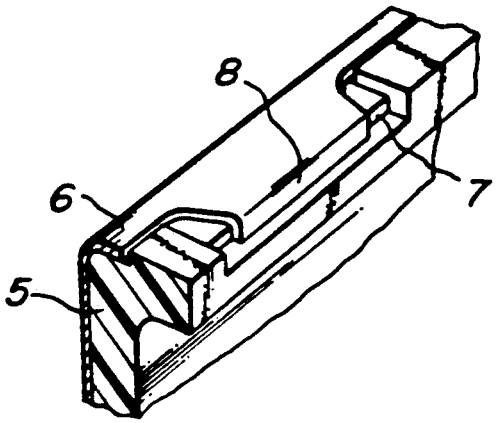

Like components in the following embodiments are designated by the same reference numerals in FIGS. 6*a*–6*d* and 7. Referring to FIGS. 1*a*, 1*b* and 1*c*, the insulating block 5 of a receptacle connector B is provided with anchoring stepped portions 7 on both sides at the center of its length. On the other hand, the metal shell 6 of the receptacle connector B is provided on both sides at the center of its length with anchoring tongues 8, each formed by inwardly extending and bending downwardly the upper end of the metal shell 6. The downwardly extending anchoring tongues 8 of the metal shell 6 are adapted to be engaged with and anchored on the anchoring stepped portions 7 of the insulating block 5, when the metal shell 6 is fitted on the insulating block 5.

With this arrangement, even if the metal shell 6 of the receptacle connector B is subjected to a downward force by the action of the metal shell 3 of a plug connector A (not shown), the center portions of the metal shell 6 sufficiently support the downward force with the aid of the anchoring tongues 8 anchored on the anchoring stepped portions 7 so that the center portions are prevented from sliding downwardly and moving away from the insulating block 5, although the center portions are weaker in mechanical strength than both ends of the metal shell 6. Therefore, fixing tongues 6*b* are prevented from disengaging from the anchoring protrusions 5*c* so that the metal shell 6 is prevented from being deformed. Moreover, the anchoring tongues 8 have a size selected to be sufficiently accommodated in spaces for forming the anchoring stepped portions 7, respectively, so that the anchoring tongues 8 do not form any obstruction when the plug connector A is inserted into the receptacle connector B.

While the anchoring stepped portions 7 and the anchoring tongues 8 are provided only at the centers of the insulating block 7 and the metal shell 6, respectively, in the shown embodiment, in addition thereto further stepped portions 7 and tongues 8 may be provided at plural positions suitably spaced.

In the embodiment shown in FIGS. 1*a* to 1*c*, the metal shell 6 is formed from a brass plate having a 0.3 mm thickness and plated with nickel and is 55 mm in length, 4 mm in width and 6 mm in height. It should be noted that the actual values are given to help better understanding of the invention and are not intended to limit the scope thereof. The metal shell 6 is provided at the center with anchoring tongues 8 one on each side, having a length of about 6 mm measured in the lengthwise direction of the metal shell 6.

Figure 2A:
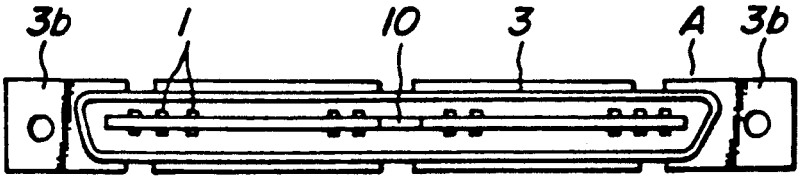
FIGS. 2*a* and 2*b* are respectively plan views illustrating the plug connector and the receptacle connector of a miniature multiple connector of another embodiment of the invention.
Figure 2B:
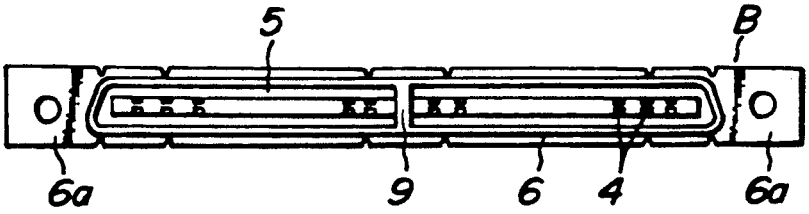
Figure 2C:
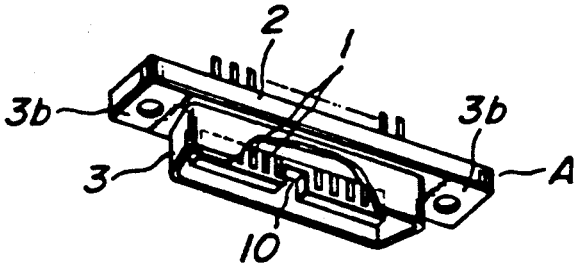
Figure 2D:
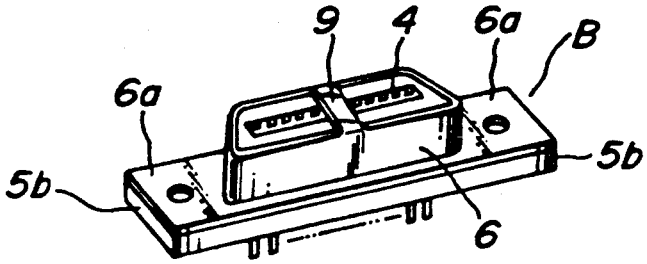
Figure 3A:
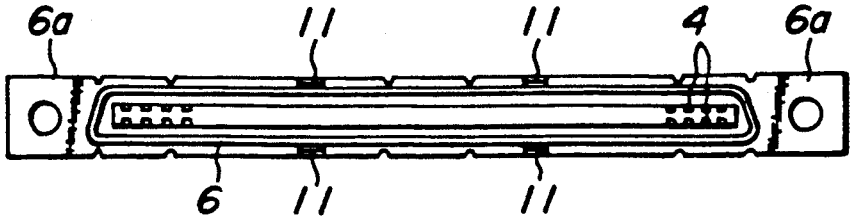
FIGS. 3*a*, 3*b*, 3*c* and 3*d* are a plan view, a front elevation, a sectional side view and a partial perspective view illustrating the receptacle connector of a miniature multiple connector of a further embodiment of the invention.
Figure 3B:
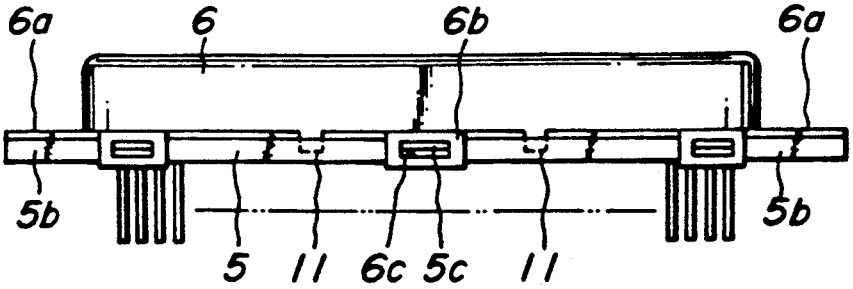
Figure 3C:
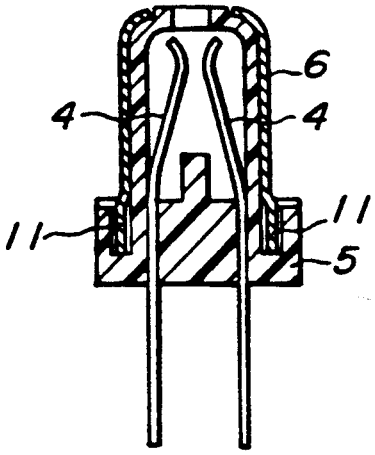
Figure 3D:
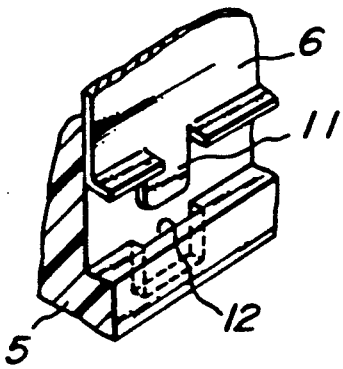

In the embodiment shown in FIGS. 2*a* to 2*d*, the metal shell 6 of a receptacle connector B is provided at the center with a bridge portion 9 which is laid across both the upper edges of the metal shell 6 as shown in FIGS. 2*b* and 2*d*. On the other hand, the insulating block 2 of a plug connector A is formed with a release notch 10 in the fitting protrusion 2a thereof at a position corresponding to the bridge portion 9.

With this arrangement, when the plug connector A is being inserted into the receptacle connector B, the center portions of the metal shell 6 sufficiently support the downward force with the aid of the bridge portion 9 of the metal shell 6 so that the center portions are prevented from sliding downwardly and moving away from the insulating block 5. Therefore, the metal shell 6 is prevented from being deformed in a manner similar to that as described in the above embodiment.

In this case, a plurality of bridge portions 9 and the release notches 10 may be provided in the metal shell 6 and the insulating block 2, respectively.

Referring to FIGS. 3a–3d illustrating another embodiment of the invention, the metal shell 6 of a receptacle connector B is formed with insert tongues 11 on both sides of its center, for example, on both sides of fixing tongues 6b. Each of the insert tongues 11 is formed by partially cutting the bent lower edge of the metal shell 6 and raising the part between cut lines to form the insert tongue 11. On the other hand, the insulating block 5 of a receptacle connector B is formed with tongue receiving apertures 12 at positions corresponding to the insert tongues 11 of the metal shell 6 so that the insert tongues 11 are inserted into the tongue receiving apertures 12 when the metal shell 6 is fitted on the insulating block 5.

In the embodiment shown in FIGS. 3a–3d, the metal shell 6 having substantially the same size as that shown in FIGS. 1a–1c is formed on each side thereof with two insert tongues 11 approximately 18 mm spaced from each other on both the sides of the fixing tongues 6b. Each of the insert tongues 11 is 2 mm in width and 1.5 mm in length for example. Each of the tongue receiving apertures 12 is substantially the same size as the insert tongue 11 and is chamfered at its opening (not shown in FIG. 3d) in order to facilitate insertion of the insert tongue 11.

With this arrangement, when the downward force acts upon the metal shell 6 of the receptacle connector B from the metal shell 3 of a plug connector A, any deformation of the metal shell 6 at its center is prevented by the insert tongues 11 received in the tongue receiving apertures 12. Therefore, the anchoring protrusions 5c do not disengage from the anchoring apertures 6c of the fixing tongues 6b so that the metal shell 6 is prevented from being deformed.

Figure 4A:
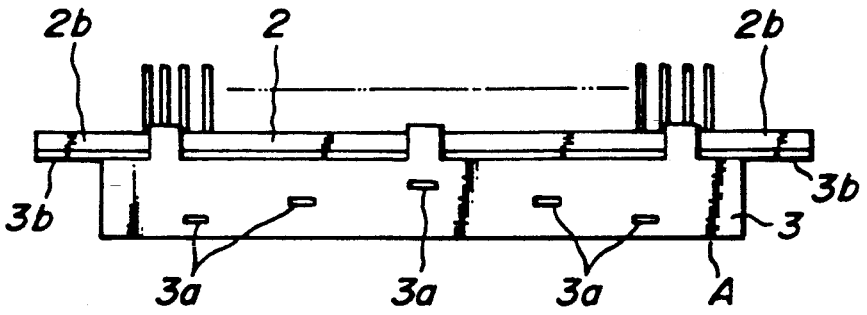
FIG. 4*a* illustrates the plug connector of a miniature multiple connector of one embodiment of the invention.
Figure 6A:
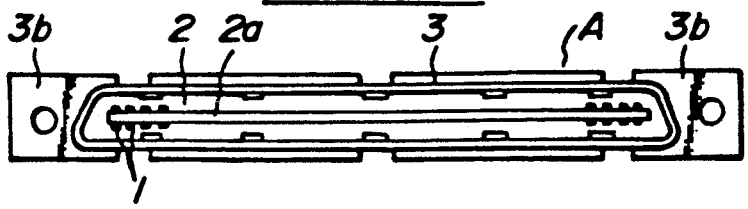
FIG 6a PRIOR ART
FIGS. 6*a* and 6*b* are respectively a plan view and a front elevation illustrating the plug connector of a miniature multiple connector of the prior art.
Figure 6B:
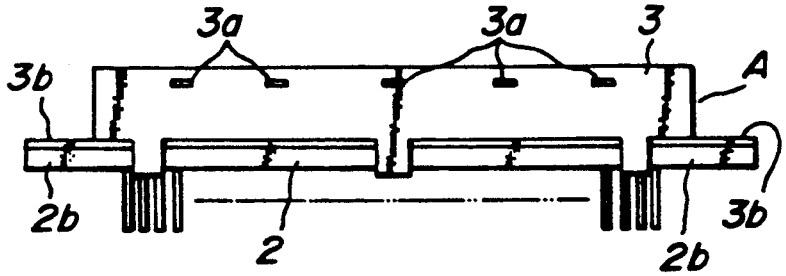
FIG 6b PRIOR ART
Figure 6C:
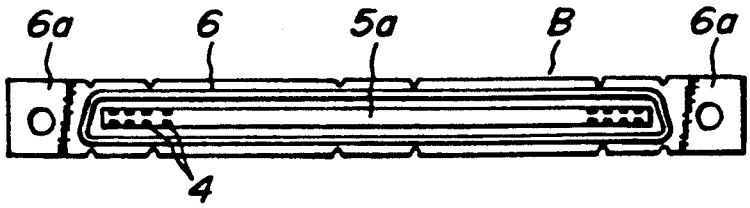
FIG 6c PRIOR ART
FIGS. 6*c* and 6*d* are a plan view and a front elevation illustrating the receptacle connector of the miniature multiple connector of the prior art, respectively.
Figure 6D:
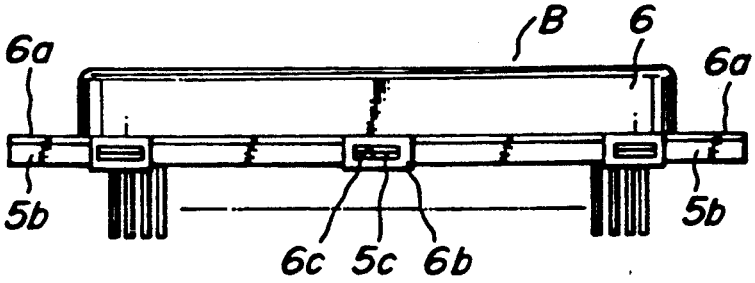
FIG 6d PRIOR ART
Figure 7:
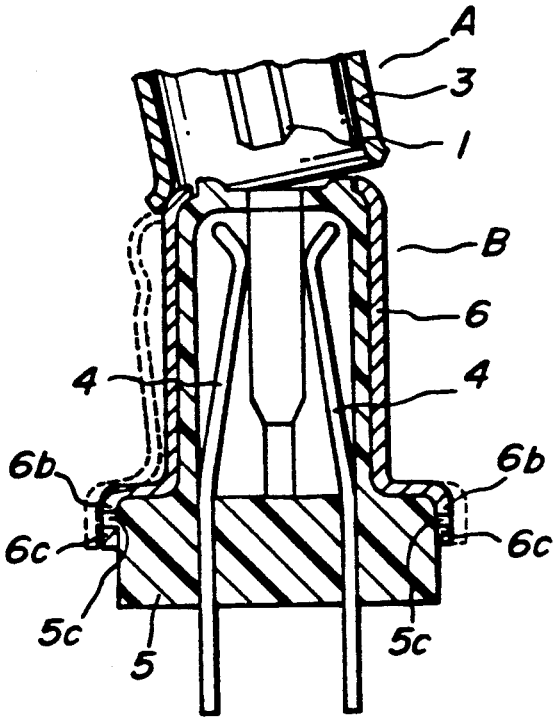
FIG. 7 PRIOR ART
FIG. 7 is an explanatory sectional view illustrating one state of fitting the metal shell of the plug connector onto the metal shell of the receptacle connector shown in FIGS. 6*a*–6*d*.

In the above embodiments, the metal shells 6 of the receptacle connectors B provide the deformation preventing function. In the following embodiments, plug connectors A provide the deformation preventing function. The deformation preventing means in the embodiment in FIGS. 4a–4c can also be applied to plug and receptacle connectors A and B whose metal shells 3 and 6 are electrically connected to each other by means of punched projections 3a provided on the metal shell 3 (FIG. 6b). In the plug connector shown in FIG. 6b, the punched projections 3a are provided in the rows in the metal shell 3 in the proximity of the insert edge. Referring to FIG. 4a in this embodiment, punched projections 3a on the metal shell 3 are arranged at positions remote from the inserting edge as they approach the center of the metal shell 3.

With this arrangement, when the plug connector A is being inserted into the receptacle connector B, first the punched projections 3a near to the opposite ends of the plug connector A contact the portions of the metal shell 6 of the receptacle connector B near its opposite ends so that the side faces at both ends of the metal shell 6 are forced and fixed to the side faces of the insulating block 5. As the plug connector A is further inserted into the receptacle connector B, the punched projections 3a nearer to the center of the receptacle connector B progressively contact the metal shell 6 so that portions of the metal shell 6 nearer to its center are forced and fixed to the side faces of the insulating block 5. Finally, the punched projections 3a at the center contact the center of the metal shell 6. In other words, the metal shell 6 is fixed to the insulating block 5 in the area of its strongest portions, intermediate the weakest portions of the metal shell 6 so that when the weakest portions of the metal shell 6 are subjected to the downward force, the most parts of the metal shell have been fixed to the insulating block 5 so that the weakest center portions of the metal shell 6 are prevented from being laterally deformed. As a result, anchoring protrusions 5c are prevented from disengaging from anchoring apertures 6c of fixing tongues 6b so that the metal shell 6 is prevented from being deformed.

In the embodiment shown in FIG. 4a, the metal shell 3 is formed from a brass plate having a 0.4 mm thickness and plated with nickel and is 57 mm in length, 5 mm in width and 7 mm in height. The punched projections 3a are arranged with an interval of about 10 mm in the lengthwise direction of the metal shell 3 and shifted in increments of 1 mm in the inserting direction of the connector in such a manner that the punched projections are nearer to the center, are remote from the insert edge of the metal shell 3. The height of the punched projections 3a is 0.2 to 0.3 mm, extending inwardly of the metal shell 3.

Figure 4B:
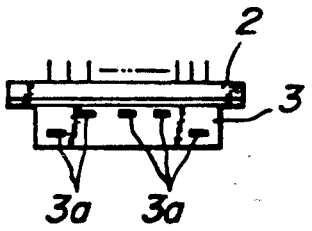
FIGS. 4*b* and 4*c* illustrate modifications of the embodiment shown in FIG. 4*a*, respectively.
Figure 4C:
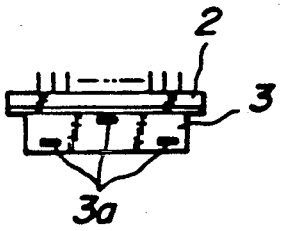

The punched projections 3a may be arranged in a manner different from that shown in FIG. 4a. For example, two punched projections 3a are arranged one at each end of the metal shell 3 near to the insert edge thereof and the remaining (for example three) punched projections 3a are arranged in a row at positions remote from the insert edge (FIG. 4b). In the embodiment shown in FIG. 4c, two punched projections 3a are arranged at both ends near to the insert edge and only one punched projection 3a is arranged at the center at a position remote form the insert edge.

Figure 5A:
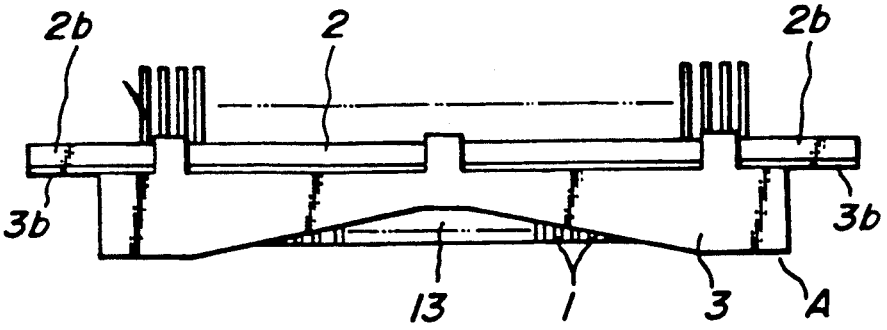
FIGS. 5*a* and 5*b* illustrate the plug connector of a miniature multiple connector of another embodiment of the invention, respectively.
Figure 5B:
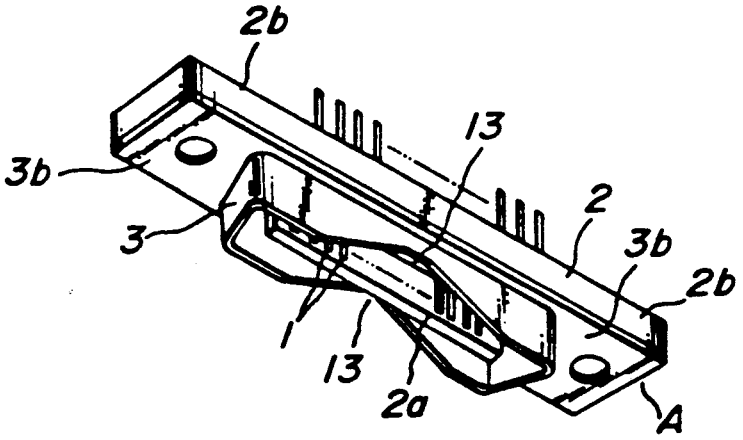

The metal shells 3 and 6 of plug and receptacle connectors A and B may be directly electrically connected without providing punched projections 3a. FIGS. 5a and 5b illustrate an embodiment of the invention applied to such a connector. The insert edge of the metal shell 3 of the plug connector A is formed in both long sides with deformation preventing notches 13. The center of each of the notches 13 is deeper than both its ends. The maximum depth of the notch 13 is selected within a range required to obtain electrical contact between both the metal shells 3 and 6.

With this arrangement, fixation of the metal shell 6 to the insulating block 5 progresses from both the ends of the metal shell highest in mechanical strength to the weakest center so that the metal shell 6 is prevented from being deformed in the same manner as in the preceding embodiment. While the deformation preventing notch 13 is triangular in FIG. 5a, it may be formed so as to be deeper stepwise.

As can be seen from the above explanation, in a connector including a plug connector and a receptacle connector having a metal shell fitted on an insulating block formed with anchoring protrusions fitted in anchoring apertures of fixing tongues of the metal shell, upon inserting the plug connector into the receptacle connector the metal shell is likely to be deformed to release the fitting between the anchoring protrusions and apertures by press-fitting force of a metal shell of the plug connector onto the metal shell of the receptacle connector. As a result, after the plug connector has been removed from the receptacle connector, it can seldom be reinserted into the receptacle connector without replacing the deformed metal shell of the receptacle connector with a new one. According to the invention, the deformation of the metal shell of the receptacle connector is prevented in a reliable manner without changing the length and width of the connector.

In the embodiment shown in FIGS. *2a–2d*, moreover, if the bridge portion 9 is provided somewhat shifted from the center of the connector, it will serve to prevent insertion of the plug connector into the receptacle connector in the incorrect relation of both ends. Therefore, the metal shell 3 may be formed in a configuration other than trapezoidal shown in FIGS. *2a* and *2b* which is for preventing such incorrect insertion.

The connector comprising the means for preventing the metal shell from being deformed according to the invention has an additional advantage of maintaining interchangeability with electrical connectors of similar kinds.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A miniature multiple electrical connector including a plug connector and a receptacle connector, said plug connector including an insulating block having contacts arranged on a fitting protrusion thereof and a metal shell fixed to the insulating block to surround the fitting protrusion with clearances therearound, and said receptacle connector including an insulating block having contacts arranged on a fitting recess thereof and a metal shell fixed to the insulating block around its fitting recess and to be in contact with the inside of the metal shell of the plug connector upon mating the plug and receptacle connectors with each other, said insulating block and said metal shell of the receptacle connector being fixed to each other by fitting anchoring protrusions provided along both sides of the insulating block of the receptacle connector in anchoring apertures of fixing tongues provided on the metal shell of the receptacle connector, wherein the metal shell of the plug connector is formed with deformation preventing notches, one on each side thereof, whose center is deeper than both ends of the notch, each notch extending from a leading edge of the metal shell.

2. The miniature multiple electrical connector as set forth in claim 1, wherein each of the deformation preventing notches is substantially triangular.

* * * * *

UNITED STATES PATENT AND TRADEMARK OFFICE

CERTIFICATE OF CORRECTION

PATENT NO. : 5,326,282

DATED : July 5, 1994

INVENTOR(S) : Yoshiaki Igarahi, Yukio Saitoh, Fumio Furuyu and Akio Yamada

It is certified that error appears in the above-indentified patent and that said Letters Patent is hereby corrected as shown below:

Column 1, line 16, delete "strongly";

line 25, change "min." to --mm--;

line 67, after "66" insert a comma (,).

Column 3, line 54, change "2a" to --2c--.

Column 5, line 36, after "length" insert a comma (,);

Column 6, line 16, delete "the";

line 32, delete the comma (,).

Column 7, line 13, delete "the".

Signed and Sealed this

Eighth Day of November, 1994

*Attest:*

*Attesting Officer*

BRUCE LEHMAN

*Commissioner of Patents and Trademarks*